United States Patent [19]

Terada

[11] Patent Number: 4,853,124

[45] Date of Patent: Aug. 1, 1989

[54] DEVICE FOR PRODUCING BUBBLING STREAM OF WATER IN BATHTUB

[75] Inventor: Seisaku Terada, Yamatotakada, Japan

[73] Assignee: Terada Pump Mfg. Co., Ltd., Nara, Japan

[21] Appl. No.: 117,837

[22] Filed: Nov. 9, 1987

[30] Foreign Application Priority Data

Apr. 8, 1987 [JP] Japan ..... 62-54897[U]

[51] Int. Cl.[4] ..... E04H 3/18

[52] U.S. Cl. ..... 210/242.2; 210/416.2; 210/238; 4/492; 4/543; 4/544; 261/120; 261/DIG. 75

[58] Field of Search ..... 210/167, 169, 221.2, 210/242.2, 242.1, 416.2, 238; 4/492, 541, 544, 542, 543; 261/DIG. 75, 120, 37, 5

[56] References Cited

U.S. PATENT DOCUMENTS

| | | | |
|---|---|---|---|
| 3,669,422 | 6/1972 | Nogaj | 210/242.2 |
| 3,820,173 | 6/1974 | Weller | 210/169 |
| 4,149,281 | 4/1979 | Bob et al. | 4/542 |
| 4,308,137 | 12/1981 | Freeman | 261/120 |
| 4,665,572 | 5/1987 | Davidson et al. | 4/492 |
| 4,726,917 | 2/1988 | Abe | 4/542 |
| 4,746,424 | 5/1988 | Drew | 210/169 |

*Primary Examiner*—Richard V. Fisher
*Assistant Examiner*—Coreen Y. Lee
*Attorney, Agent, or Firm*—Wenderoth, Lind & Ponack

[57] ABSTRACT

A device for discharging bubbling streams of water into a bath. The device has a main float and a subfloat mounted on top of the main float so as to be floatable in the water in a bathtub and movable up and down with the change in the water level. The hot water in the bathtub is sucked up into the device from its bottom by a pump driven by a motor, the pump and the motor being mounted in the main float. The water drawn into the device is filtered by means of a strainer and sent up to the top of the device through a cylindrical space formed around the motor and passed through a plurality of injection nozzles, where air is mixed into the water to form bubbling streams, and through a plurality of downwardly angled discharge ports into the bathtub under the surface of the water.

1 Claim, 1 Drawing Sheet

DEVICE FOR PRODUCING BUBBLING STREAM OF WATER IN BATHTUB

BACKGROUND OF THE INVENTION

The present invention relates to a device for producing a bubbling stream of water in a bathtub.

Bathing in hot water charged with bubbles formed by blowing air into the water is believed to be good for health because of its massaging, cleansing and invigorating action. Thus, various devices for mixing bubbles into water in a bath have been proposed. However, most of the prior art devices of this type are designed to be fixedly mounted on a bathtub and none of them are designed to be readily mounted on an existing home bathtub.

SUMMARY OF THE INVENTION

It is an object of the present invention to provide an improved device for forming a bubbling stream of water in a bathtub, which device is easy to mount on a bathtub and easy to assemble.

In accordance with the present invention, there is provided a device for forming a bubbling stream of water for use in a bathtub, comprising a float body having buoyancy in water, a pump mounted in the float body, a motor for driving the pump, and a strainer for filtering the water sucked by the pump, the float body being provided with a plurality of injection nozzles for mixing air into the water sucked up by the pump and with a plurality of downwardly angled discharge ports for discharging bubbling streams of water into the bathtub.

The pump mounted in the main float which is kept afloat in the bath is driven by the motor to suck up the hot water through the strainer into the pump. The hot water drawn into the pump is then fed to the injection nozzles provided in the subfloat and is mixed with the air taken in through the air intake ports to form a bubbling stream, which is discharged from the discharge ports back into the bath.

The device according to the present invention can be brought into operative condition very easily just by making it float in the bathtub. The main float and the subfloat move up and down with the change in the water level to keep their height unchanged with respect to the water level.

The downwardly angled discharge ports for bubbling streams provided at the lower part of the subfloat have their openings submerged under water to discharge the bubbling streams directly into the water and thus to keep the noise caused by the streams to a minimum level, which minimum noise level is not attainable with the type of devices in which a bubbling stream is blown against the surface of the water. The injection nozzles and their respective discharge ports are so arranged as to uniformly blow out the bubbling streams downwardly and outwardly all around the device to allow the bubbles to be dispersed throughout the bath. Also, the streams blown out downwardly help to propel the device upwardly, eliminating the necessity of preparing a large-sized float to give a sufficient buoyancy to the device.

Further, the annular weight mounted in the main float on its obttom wall serves to hold the device stably in its upright position.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENT

Figure 1:
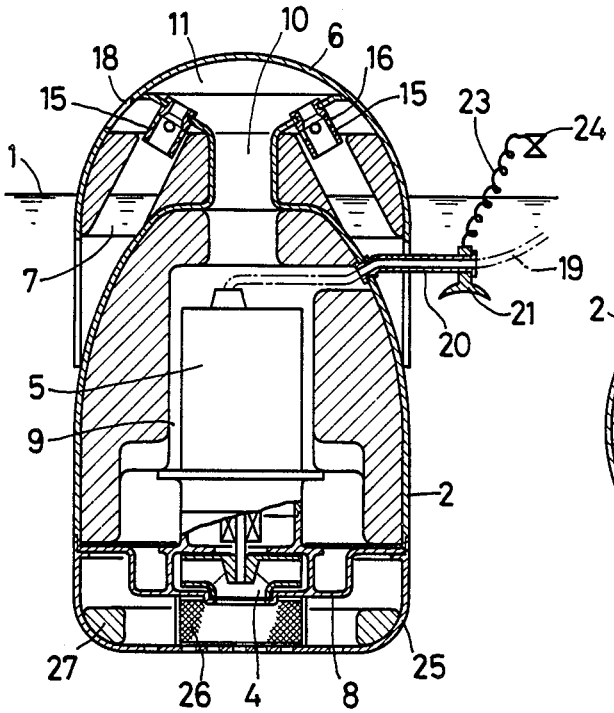
FIG. 1 is a vertical sectional side view of the device embodying the present invention.

In FIG. 1, numeral 1 indicates the hot water in a bathtub and a main float 2 is a hollow casing stuffed with a buoyant material such as expanded styrol. The main float 2 also contains a pump 4 and a driving motor 5 for the pump.

On the main float 2, a subfloat 6 is fixedly mounted which is a semispherical hollow casing stuffed partially with expanded styrol and formed with a plurality of discharge ports 7 angularly spaced for a bubbling stream of water.

A casing 8 of the pump 4 is formed with a discharge port in its top wall which communicates with a cylindrical space 9 formed around the motor 5. The space 9 is further in communication with a passageway 10 formed at a neck portion of the main float 2 and with a space 11 formed in the subfloat 6 at its upper central portion.

A plurality of injection nozzles 15 are provided in the subfloat 6 in such a manner as to have their lower ends open to the downwardly angled discharge ports 7 and their upper ends open to the space 11.

A plurality of apertures 16 are formed in each nozzle 15 at its intermediate portion so that the inside of the nozzles 15 will communicate with a plurality of air intake ports 18 formed in the subfloat 6.

Figure 3:
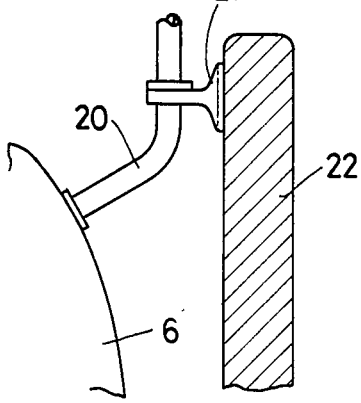
FIG. 3 is an enlarged side view of one example of the fastening means attached to the power cord.

A waterproof power cord 19 for the motor 5 is passed through a flexible hose 20 having one end thereof secured to the main float 2. The hose 20 is provided on its outer periphery with a sucker 21 adapted to stick to a side wall 22 of the bathtub as shown in FIG. 3. As a fastening means, a chain 23 (FIG. 1) adapted to be tied to a faucet 24 or the like may be used instead of the sucker 21.

Numeral 25 designates a bottom casing fixed to the bottom of the main float 2 and formed in its bottom wall with a plurality of apertures. In the bottom casing 25, a spongy strainer 26 is mounted so as to cover an intake port formed in the pump casing 8. An annular weight 27 is fixed to the inner wall of the casing 25.

In operation, the pump 4 in the main float 2 is driven by the motor 5 to cause the hot water 1 in the bathtub to be sucked up and filtered through the strainer 26 into the pump 4. The water will then pass through the cylindrical space 9, where the water is heated by the motor 5, and through the passageway 10 and the space 11 so as to be blown through the injection nozzles 15 and the discharge ports 7.

The water will be mixed with the air taken in through the air intake ports 18 to be discharged into the bath in the form of a bubbling stream.

Figure 4:
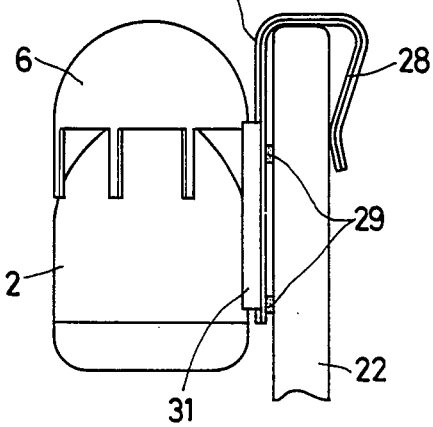
FIG. 4 is a side view of another means for mounting the device according to the present invention on a bathtub.
Figure 5:
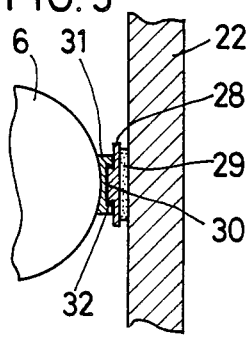
FIG. 5 is a transverse sectional plan view of a portion of the same.

In this embodiment, the device of the present invention is attached to the bathtub or the faucet by the fastening means attached to the reinforcing hose 20 so that the main float 2 and the subfloat 6 will move up and down with the change in the level of the water. The device may be mounted on the bathtub in such a manner shown in FIGS. 4 and 5 and described below.

A mounting frame 28 made of a resilient material such as synthetic resin is resiliently and removably mounted on the side wall 22 of the bathtub. Rubber pieces 29 secured to the frame 28 are adapted to stick closely to the side wall 22 to hold the frame stably in position and to protect the surface of the bathtub.

The mounting frame 28 is provided with a longitudinal guide rail 30. A slide frame 31 formed with a dovetail groove 32 complementary in the cross-sectional shape to the guide rail 30 is fixed to the main float 2 and is adapted to be slidably and detachably mounted on the guide rail 30.

Figure 2:
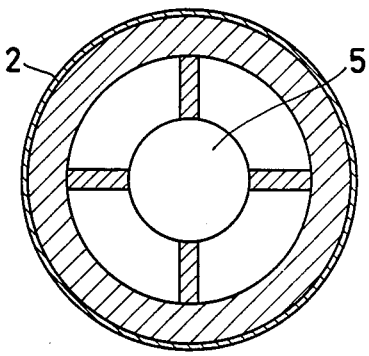
FIG. 2 is a transverse sectional plan view of the same.

With this arrangement, the main float 2 and the subfloat 6 can be raised and lowered together with the slide frame 31 along the guide rail 30 with the change in the water level in the same manner as the embodiment shown in FIGS. 1 to 3.

Although in the preferred embodiment the body of the device comprise the main float and the subfloat, it may comprise a single float.

Although in the preferred embodiment the weight 27 is used to adjust the buoyancy of the device, it may be omitted by giving a proper buoyancy to the body of the device.

Although in the present invention the main float and the subfloat are formed by mounting a float in a float casing, they may be formed by mounting a float outside of the casing.

What is claimed is:

1. A device for forming a bubbling stream of water for use in a bathtub, comprising a float body, a pump mounted in said float body, a motor for driving said pump, and a strainer for filtering the water sucked by said pump, said float body being provided with a plurality of injection nozzles each having an air intake port for mixing air into the water sucked up by said pump and with a plurality of downwardly angled discharge ports for discharging bubbling streams of water into the bathtub, said float body containing a buoyant material means in an amount sufficient for causing the buoyancy of the body to be sufficient so that during operation, the injection nozzles are above the level of the water surface and the discharge ports are below the level of the water surface, and whereby the downwardly angled discharged ports discharge water downward and outward providing an upward force on said body to facilitate floating and to reduce the need for buoyant material.

* * * * *